US007615929B2

(12) United States Patent
Bewlay et al.

(10) Patent No.: US 7,615,929 B2
(45) Date of Patent: Nov. 10, 2009

(54) CERAMIC LAMPS AND METHODS OF MAKING SAME

(75) Inventors: Bernard Patrick Bewlay, Schenectady, NY (US); Bruce Alan Knudsen, Amsterdam, NY (US); Mohamed Rahmane, Clifton Park, NY (US); James Anthony Brewer, Scotia, NY (US); James Scott Vartuli, Rexford, NY (US); Istvan Csanyi, Dunakeszi (HU); Jozsef Gabeli, Szodliget (HU); Agoston Boroczki, Budapest (HU); Robert Baranyi, Budaors (HU)

(73) Assignee: General Electric Company, Niskayuna, NY (US)

( * ) Notice: Subject to any disclaimer, the term of this patent is extended or adjusted under 35 U.S.C. 154(b) by 492 days.

(21) Appl. No.: 11/172,650

(22) Filed: Jun. 30, 2005

(65) Prior Publication Data

US 2007/0001612 A1 Jan. 4, 2007

(51) Int. Cl.
*H01J 17/18* (2006.01)
*H01J 61/36* (2006.01)

(52) U.S. Cl. ..... 313/625; 313/623; 313/624; 313/113

(58) Field of Classification Search ..... None
See application file for complete search history.

(56) References Cited

U.S. PATENT DOCUMENTS 3,363,134 A 1/1968 Johnson
3,385,463 A 5/1968 Lange
3,659,138 A 4/1972 Johnson et al.
3,662,455 A 5/1972 Anderson
3,693,007 A 9/1972 Kerekes
3,872,341 A 3/1975 Werner et al. ..... 313/217
3,882,344 A 5/1975 Knochel et al. ..... 313/217
3,882,346 A 5/1975 McVey ..... 313/253
3,953,177 A 4/1976 Sedlatschek et al.
4,103,200 A 7/1978 Bhalla ..... 313/221
4,291,250 A 9/1981 Bhalla ..... 313/220
4,409,517 A 10/1983 Van Der Sande et al.

(Continued)

FOREIGN PATENT DOCUMENTS

DE 1182842 12/1964

(Continued)

OTHER PUBLICATIONS

Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.

(Continued)

*Primary Examiner*—Ashok Patel
(74) *Attorney, Agent, or Firm*—Patrick K. Patnode

(57) ABSTRACT

A lamp having a ceramic arc envelope, an end structure coupled to the ceramic arc envelope and extending across an opening in the ceramic arc envelope, where the end structure comprises a passageway communicative with an interior chamber of the ceramic arc envelope is provided. The lamp further includes a molybdenum-rhenium electrode lead extending through and sealed with the passageway. The molybdenum-rhenium electrode lead includes a molybdenum-rhenium alloy. Furthermore, the lamp includes an arc electrode tip coupled to the electrode lead inside the interior chamber.

24 Claims, 10 Drawing Sheets

U.S. PATENT DOCUMENTS

| | | | | |
|---|---|---|---|---|
| 4,464,603 | A | 8/1984 | McVey | |
| 4,507,584 | A | 3/1985 | Coaton et al. | |
| 4,545,799 | A | 10/1985 | Rhodes et al. | |
| 4,585,972 | A | 4/1986 | Hing | |
| 4,707,636 | A | 11/1987 | Morris | |
| 4,780,646 | A | 10/1988 | Lange | |
| 4,804,889 | A | 2/1989 | Reid et al. | 313/624 |
| 5,057,048 | A | 10/1991 | Feuersanger et al. | |
| 5,111,108 | A * | 5/1992 | Goodman et al. | 313/630 |
| 5,321,335 | A | 6/1994 | Klug et al. | |
| 5,424,609 | A | 6/1995 | Geven et al. | |
| 5,426,343 | A | 6/1995 | Rhodes et al. | |
| 5,552,670 | A | 9/1996 | Heider et al. | |
| 5,592,049 | A * | 1/1997 | Heider et al. | 313/625 |
| 5,725,827 | A | 3/1998 | Rhodes et al. | |
| 5,783,907 | A | 7/1998 | Suzuki et al. | |
| 5,861,714 | A * | 1/1999 | Wei et al. | 313/625 |
| 5,973,453 | A | 10/1999 | Van Viet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,215,254 | B1 | 4/2001 | Honda et al. | |
| 6,216,889 | B1 | 4/2001 | Chang | |
| 6,224,449 | B1 | 5/2001 | Niimi et al. | |
| 6,265,827 | B1 | 7/2001 | Takahashi et al. | |
| 6,294,871 | B1 | 9/2001 | Scott et al. | |
| 6,300,716 | B1 | 10/2001 | Honda et al. | |
| 6,375,533 | B1 | 4/2002 | Torikai et al. | |
| 6,404,129 | B1 | 6/2002 | Hendricx et al. | |
| 6,528,945 | B2 | 3/2003 | Kelly et al. | |
| 6,583,563 | B1 | 6/2003 | Venkataramani et al. | |
| 6,635,993 | B1 | 10/2003 | Niimi | |
| 6,642,654 | B2 | 11/2003 | Niimi | |
| 6,657,388 | B2 | 12/2003 | Wijenberg et al. | |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | 313/623 |
| 6,815,894 | B2 | 11/2004 | Takagaki et al. | |
| 6,873,109 | B2 | 3/2005 | Ishigami et al. | |
| 2002/0027421 | A1 | 3/2002 | Kaneko et al. | |
| 2002/0117965 | A1 | 8/2002 | Kotter et al. | |
| 2002/0185974 | A1 * | 12/2002 | Nakano et al. | 313/623 |
| 2003/0062838 | A1 * | 4/2003 | Niimi | 313/634 |
| 2003/0222581 | A1 * | 12/2003 | Niimi | 313/623 |
| 2003/0234612 | A1 * | 12/2003 | Kelly et al. | 313/623 |
| 2004/0070322 | A1 * | 4/2004 | Ishigami et al. | 313/112 |
| 2004/0119413 | A1 | 6/2004 | Kebbede et al. | 313/624 |
| 2004/0119414 | A1 | 6/2004 | Bewlay et al. | 313/636 |
| 2004/0124776 | A1 | 7/2004 | Iorio et al. | 313/625 |
| 2004/0135510 | A1 | 7/2004 | Bewlay et al. | 313/624 |
| 2004/0174121 | A1 | 9/2004 | Tsuda et al. | |
| 2004/0183446 | A1 | 9/2004 | Grundmann et al. | |
| 2005/0007020 | A1 | 1/2005 | Tsuda et al. | |
| 2005/0264213 | A1 * | 12/2005 | Dambacher et al. | 313/631 |
| 2005/0280370 | A1 * | 12/2005 | Henning et al. | 313/631 |
| 2006/0001346 | A1 | 1/2006 | Vartuli et al. | |
| 2006/0008677 | A1 | 1/2006 | Bewlay et al. | |
| 2006/0012306 | A1 | 1/2006 | Bewlay et al. | |
| 2006/0068679 | A1 * | 3/2006 | Bewlay et al. | 445/26 |

FOREIGN PATENT DOCUMENTS

| | | |
|---|---|---|
| EP | 0807957 | 11/1997 |
| EP | 0935278 | 8/1999 |
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| GB | 816135 | 7/1959 |
| JP | 2004214194 | 7/2004 |
| WO | WO9825294 | 6/1998 |
| WO | WO03058674 | 7/2003 |
| WO | WO03099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

Lei Wen et al., "*Synthesis of Nanocrystalline Yttria Powder and Fabrication of Transparent YAG Ceramics*", Journal of the European Ceramic Society, vol. 24, pp. 2681-2688, 2003.

D. Hreniak et al., "*Synthesis and Optical Properties of* $Nd^3$+*—Doped* $Y_3Al_5O_{12}$ *Nanoceramics*", Journal of Alloys and Compounds, vol. 341, pp. 183-186, 2002.

Guanshi Qin et al., "*Upconversion Luminescence of* $Er^3$+ *In Highly Transparent YAG Ceramics*", Solid State Communications, vol. 132, pp. 103-106, 2004.

Jianren Lu et al., "*Neodymium Doped Yttrium Aluminum Garnet* ($Y_3Al_5O_{12}$) *Nanocrystalline Ceramics—A New Generation of Solid State Laser and Optical Materials*", Journal of Alloys and Compounds, vol. 341, pp. 220-225, 2002.

A.K. Pradhan et al., "*Synthesis of Neodymium-Doped Yttrium Aluminum Garnet* (*YAG*) *Nanocrystalline Powders Leading to Transparent Ceramics*", Materials Research Bulletin, vol. 39, pp. 1291-1298, 2004.

U.S. Appl. No. 10/952,940, filed Sep. 29, 2004, Bewlay et al.

* cited by examiner

CERAMIC LAMPS AND METHODS OF MAKING SAME

BACKGROUND

The invention relates generally to the field of lighting systems and, more particularly, to high-intensity discharge lamps.

High-intensity discharge lamps generally include an arc tube, end plugs sealed against and into opposite ends of the arc tube, lead wires extending through the opposite end plugs, arc electrode tips coupled to the respective lead wires inside the arc tube, and one or more seal materials between the various components. These lamp components are typically made of different materials to enable the lamps to withstand certain operational conditions, such as high temperature (e.g., 900° C. to 1200° C.), high-pressure (e.g., 15 psi to 6000 psi), and corrosive dosing materials (e.g., halides) inside the lamps. Unfortunately, these different materials have different coefficients of thermal expansion (CTE), which can lead to thermal stress and cracks during operation of the lamp. For example, the joint between a lead wire and the end plugs and/or the arc tube can be susceptible to thermal stress and cracks due to different CTEs of the lead wire, the end plugs and/or the arc tubes, and the seal material.

Accordingly, a need exists for a conductive and corrosion resistant lead system having a relatively close CTE match with the arc tube and/or end plugs.

BRIEF DESCRIPTION

In certain embodiment, the present technique provides a lamp having a ceramic arc envelope, an end structure coupled to the ceramic arc envelope and extending across an opening in the ceramic arc envelope, where the end structure includes a passageway communicative with an interior chamber of the ceramic arc envelope. The lamp further includes a molybdenum-rhenium electrode lead extending through and sealed with the passageway, where the molybdenum-rhenium electrode lead includes a molybdenum-rhenium alloy. Furthermore, the lamp includes an arc electrode tip coupled to the electrode lead inside the interior chamber.

In another embodiment, the present technique provides a system having a lighting device. The lighting device includes a ceramic arc envelope having an interior, a dosing material disposed within the ceramic arc envelope, where the dosing material includes a corrosive material. The lighting device further includes an end structure coupled to the ceramic arc envelope and extending across an open end of the ceramic arc envelope, where the end structure includes a hollow leg communicative with the interior, an electrode lead extending at least partially through the hollow leg, where the electrode lead includes a molybdenum-rhenium alloy, and an arc electrode tip coupled to the coil assembly.

In yet another embodiment, the present technique provides a method of making a lamp. The method includes coupling an end structure to the ceramic arc envelope and extending across an open end of a ceramic arc envelope, disposing a molybdenum-rhenium electrode lead in a passageway that extends through the end structure, wherein the molybdenum-rhenium electrode lead comprises a molybdenum-rhenium alloy. The method further comprises sealing the molybdenum-rhenium electrode lead to the passageway.

In further embodiment, the present technique provides a method of operating a lamp. The method includes reducing halide attack and thermo-mechanical stress via a molybdenum-rhenium electrode lead coupled to an electrode tip within a ceramic arc envelope, wherein the molybdenum-rhenium electrode lead comprises a molybdenum-rhenium alloy.

DRAWINGS

These and other features, aspects, and advantages of the present invention will become better understood when the following detailed description is read with reference to the accompanying drawings in which like characters represent like parts throughout the drawings, wherein:

FIG. 1 is a cross-sectional perspective view of an exemplary lamp having a ceramic arc envelope, end structures coupled to the ceramic arc envelope and extending across an opening in the ceramic arc envelope at opposite ends of the ceramic arc envelope, and having a passageway and a molybdenum-rhenium electrode lead extending through and sealed with the passageway in accordance with embodiments of the present technique FIGS. 2-4 are cross-sectional views of alternative lamps having a ceramic arc envelope, end structures coupled to the ceramic arc envelope and extending across an opening in the ceramic arc envelope, and having a passageway and a molybdenum-rhenium electrode lead extending through and sealed with the passageway in accordance with embodiments of the present technique;

DETAILED DESCRIPTION

Embodiments of the present technique provide lamps employing molybdenum-rhenium electrode leads, which improve performance and mechanical stability of the lamps. Advantageously, the molybdenum-rhenium electrode leads provide reduced thermo-mechanical stress in the ceramic arc envelope at least partly due to an improved match between the coefficients of thermal expansion of the molybdenum-rhenium electrode leads and the ceramic arc envelope. Also, the molybdenum-rhenium electrode leads provide reduced halide attack due to their general chemical resistance towards the dosing materials (e.g., metal halides) employed in the ceramic arc envelope. Moreover, the lamps of the present technique facilitate the sealing process by employing shorter seal glass lengths to bond the electrode leads to the end structures. These features introduced above are described in detail below with reference to figures of several exemplary embodiments of the present technique. However, various combinations and variations of the disclosed features are also within the scope of the present technique.

Figure 1:
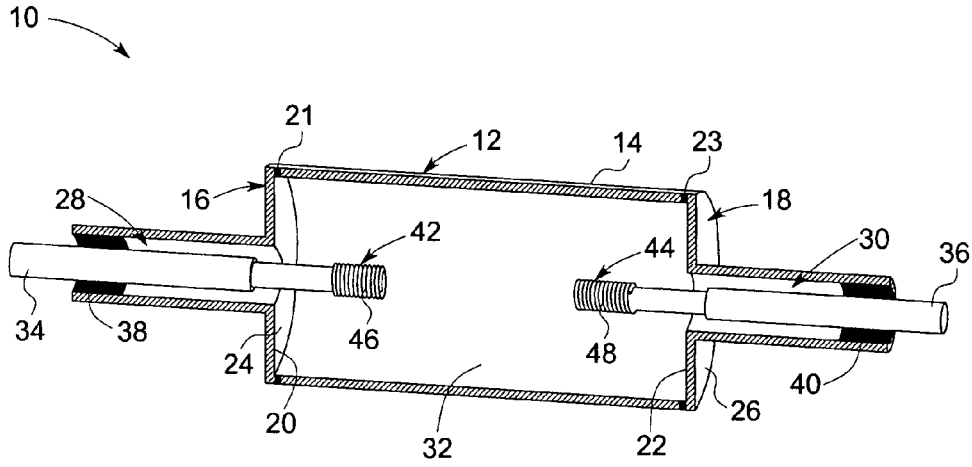
Figure 2:
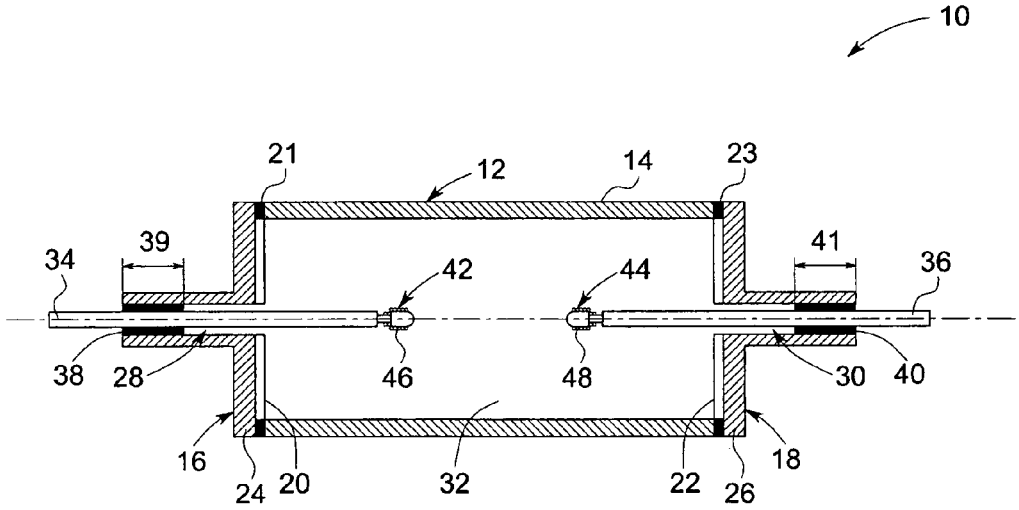

FIG. 1 is a cross-sectional perspective view of an exemplary lamp 10 showing internal features in accordance with certain aspects of the present technique. FIG. 2 is a cross-sectional side view of the lamp 10 of FIG. 1. As illustrated in FIGS. 1 and 2, the lamp 10 comprises a hermetically sealed assembly of a hollow body or an arc envelope assembly 12. As discussed in further detail below, the arc envelope assembly 12 includes a ceramic arc envelope 14. In certain embodiments, the ceramic arc envelope 14 is made of quartz, yttrium aluminum garnet, ytterbium aluminum garnet, micro grain polycrystalline alumina, polycrystalline alumina, sapphire, and yttria. Other components of the arc envelope assembly 12 may be formed from conventional lamp materials, such as polycrystalline alumina (PCA).

Further, in the illustrated embodiment, the end structures 16 and 18 are coupled to, and extend across, the openings in opposite ends 20 and 22 of the ceramic arc envelope 14. In other words, the end structures 16 and 18 generally cover and close the opposite ends 20 and 22 of the ceramic arc envelope 14. Further, as illustrated, the end structures 16 and 18 may be sealed to the ceramic arc envelope 14 by employing seal materials or sealants 21 and 23. In some embodiments, these seal materials may include a sealing glass, such as calcium aluminate, dysprosia-alumina-silica, magnesia-alumina-silica, and yttria-calcia-alumina. Other potential non-glass seal materials include niobium-based brazes. As will be appreciated, the seal materials 21 and 23 used for the foregoing bonds have characteristics at least partially based on the type of materials used for the various lamp components, e.g., the arc envelope 14 and end structures 16 and 18. For example, some embodiments of the lamp 10 are formed from a sapphire tubular arc envelope 14 bonded with polycrystalline alumina (PCA) end structures 16 and 18. By further example, some embodiments of the lamp 10 are formed from a YAG tubular arc envelope 14 bonded with cermet end structures 16 and 18, which have a similar coefficient of thermal expansion (CTE) as alumina (PCA). The seal materials 21 and 23 generally have a CTE to control stresses at each interface between the arc envelope 14 and the end structures 16 and 18, e.g., each PCA/sapphire seal interface. For example, the seal materials 21 and 23 may include a niobium braze or a seal glass that minimizes tensile stresses developed upon cooling, e.g., a seal glass with a CTE value that is the average value of PCA and the a-axis or radial value of edge-defined-grown sapphire. In certain embodiments, localized heating is applied to the seal materials 21 and 23 to control the local microstructural development of the seal material, e.g., the seal glass.

In other embodiments, the end structures 16 and 18 may be diffusion bonded to opposite ends 20 and 22 of the arc envelope 14 via material diffusion without using any seal material. For example, localized heating (e.g., a laser) may be applied to the interface between the end structures 16 and 18 and the opposite ends 20 and 22 to bond the materials together, thereby forming a hermetical seal. Further, in certain embodiments where the end structures 16 and 18 include ceramic parts, the end structures 16 and 18 and the arc envelope 14 may be co-sintered together.

Further, in certain embodiments, the end structures 16 and 18 include flat structures 24 and 26 having an opening into protruding passageways, such as hollow legs or passageways 28 and 30 communicative with an interior chamber 32 of the ceramic arc envelope 14. Further, in certain embodiments, the dosing material is disposed within the interior chamber 32. In the illustrated embodiment, the hollow legs 28 and 30 may also be used as dosing tubes to introduce dosing material in the interior chamber 32 of the ceramic arc envelope 14. In certain embodiments, the dosing material is mercury-free, in other words, the dosing material includes one or more materials without any mercury. In certain embodiments, the dosing material includes a rare gas, or a metal, or a metal halide, or combinations thereof. In these embodiments, the rare gas may include argon, or xenon, or krypton, or combinations thereof. Further, in these embodiments, the metal may include mercury, or zirconium, or titanium, or hafnium, or gallium, or aluminum, or antimony, or indium, or germanium, or tin, or nickel, or magnesium, or iron, or cobalt, or chromium, or indium, or copper, or calcium, or lithium, or cesium, or potassium, or yttrium, or tantalum, or thallium, or lanthanum, or cerium, or praseodymium, or neodymium, or samarium, or europium, or yttrium, or gadolinium, or terbium, or dysprosium, or holmium, or erbium, or thulium, or lutetium, or scandium, or ytterbium, or combinations thereof. In some embodiments, the dosing material includes rare gas and mercury. In other embodiments, the dosing material includes halide, such as bromide, or a rare earth metal halide. In these embodiments, the dosing material includes a halide, or a metal halide, or mercury, or sodium, or sodium iodide, or thallium iodide, or dysprosium iodide, or holmium iodide, or thulium iodide, or a noble gas, or argon, or krypton, or xenon, or combinations thereof. In some embodiments, the dosing material is corrosive. Accordingly, in these embodiments, it is desirable to have an end structure made of a material, which is resistant to the corrosive dosing material. In some of these embodiments, the end structures 16 and 18 are formed from a variety of ceramics and other suitable materials, such as zirconia stabilized cermet, alumina-tungsten, or other conductive or non-conductive materials depending on the application.

In certain embodiments, the arc envelope 14 may include a variety of different geometrically shaped structures, such as a hollow cylinder, or a hollow oval shape, or a hollow sphere, or a bulb shape, or a rectangular shaped tube, or another suitable hollow transparent body. Moreover, as described in detail below, the end structures 16 and 18 may have a variety of geometries, such as a plug-shaped geometry that at least partially extends into the ceramic arc envelope 14 or a cap-shaped geometry that at least partially overwraps around the edges of the opposite ends 20 and 22 of the arc envelope 14. In other embodiments, the end structures 16 and 18 may have a substantially flat mating surface, which is butt-sealed against the opposite ends 20 and 22 without extending into an interior or wrapping around an exterior of the arc envelope assembly 12 (e.g., arc tube).

Further, the illustrated arc envelope assembly 12 includes molybdenum-rhenium electrode leads 34 and 36 extending through and sealed with the passageways 28 and 30 by using seal glasses 38 and 40. During operation, the electrode leads facilitate power supply from a power source to the electrode tips 42 and 44 to create an arc between the electrode tips 42 and 44. As will be appreciated, it is desirable to have a thermal match between the seal glass 38 and 40 and the materials employed in the hollow legs 28 and 30 and the electrode leads 34 and 36. In some embodiments, the seal glasses 38 and 40 may include materials, such as calcium-aluminate, dysprosia-alumina-silica, magnesia-alumina-silica, and yttria-calcia-alumina. Advantageously, the lengths 39 and 41 of the seal materials 38 and 40, as illustrated in FIG. 2, may vary depending on the material employed in the hollow legs 28 and 30 and the electrode leads 34 and 36 to improve the thermal match between the three components.

Further, in certain embodiments, the molybdenum-rhenium alloy employed in the electrode leads 34 and 36 includes about 35 weight percent to about 55 weight percent of rhenium. In some embodiments, the molybdenum-rhenium alloy includes about 40 weight percent to about 48 weight percent of rhenium. As will be appreciated, because of the operational limitations caused by high temperature and high-pressure operations of these lamps, various parts of these lamps are made of different types of materials. In view of the potential for thermal stresses and cracks resulting from substantially mismatched (coefficient of thermal expansions) CTEs, it is desirable to provide the electrode leads 34 and 36 and the arc envelope 14 with comparable CTEs to reduce the likelihood of thermal stresses and cracks. Accordingly, in some of these embodiments, the molybdenum-rhenium alloy has a CTE varying in a range from about $5.5\times10^{-6}$/K to about $7\times10^{-6}$/K. In these embodiments, the ceramic arc envelope 14 has a CTE varying in a range from about $7.5\times10^{-6}$/K to about $9\times10^{-6}$/K. In an exemplary embodiment, the molybdenum-rhenium alloy has a CTE in a range from about $6\times10^{-6}$/K to about $7\times10^{-6}$/K. Moreover, the molybdenum-rhenium alloy employed in the electrode leads 34 and 36 is generally resistant to the corrosive dosing material (e.g., metal halides). Further, in these embodiments, the electrode leads 34 and 36 have a ductility in a range from about 0.1 percent to about 3.0 percent. As will be appreciated, a high value of ductility in the lead system reduces the likelihood of breakage or cracking, e.g., during bending, of the electrode leads 34 and 36. Furthermore, it is desirable to have a substantially close CTE match between the seal materials 34 and 36 and both the electrode leads 34 and 36 and the ceramic arc envelope 14 to minimize the thermal stresses that may be generated during sealing of the lamp and subsequent operation.

Furthermore, the electrode tips 42 and 44 may include overwraps, such as overwraps 46 and 48. As will be appreciated, these overwraps 46 and 48 sometimes act as heat sinks and absorb the heat from the electrode tips 42 and 44 and dissipate the heat into the surroundings. In some embodiments, the electrode tips 42 and 44 and/or the overwraps 46 and 48 may include tungsten, or tungsten alloys, or rhenium, or rhenium alloys, or tantalum, or tantalum alloys, or combinations thereof.

Figure 3:
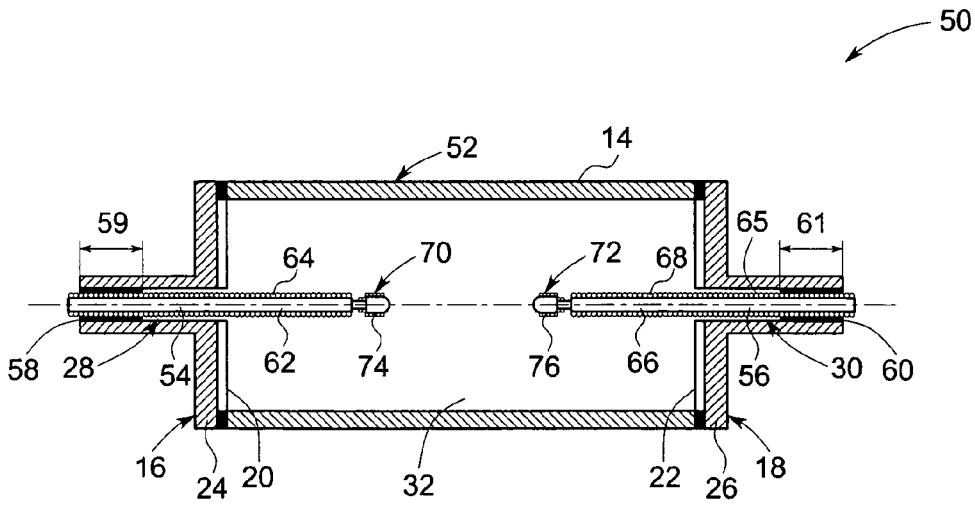

In an alternative embodiment shown in FIG. 3, the lamp 50 employs an alternative lead system disposed in an arc envelope assembly 52 having a ceramic arc envelope 14 and the end structures 16 and 18 coupled to the opposite ends 20 and 22 of the ceramic arc envelope 14. As illustrated, the end structures 16 and 18 include flat structures 24 and 26 having openings extending into protruding passageways, such as hollow legs 28 and 30 communicative with an interior chamber 32. Further, the arc envelope assembly 52 includes electrode leads 54 and 56 extending through and sealed with the passageways 24 and 26 by using seal glasses 58 and 60. In the illustrated embodiment, the electrode lead 54 includes a shank, such as a mandrel 62 having a coil overwrap 64 wrapped around the circumference and along the length of the mandrel 62. Similarly, the electrode lead 56 disposed opposite to the electrode lead 54 includes a shank, such as a mandrel 66 having a coil overwrap 68 wrapped around the circumference and along the length of the mandrel 66. As will be appreciated, the dimensions of the mandrels 62 and 66 and overwraps 64 and 68 are correspondingly adjusted to the dimensions of the passageways 28 and 30. For example, in some embodiments, the diameter of the mandrels 62 and 66 may be about 0.40 mm and the diameter of the overwraps 64 and/or 68 may be about 0.125 mm. Similarly, for lamps with passageways 28 and 30 having relatively larger diameter, the diameter of the mandrels 62 and 66 may be about 0.50 mm and the diameter of the overwraps 64 and/or 68 may be about 0.175 mm. Likewise, for lamps with even larger diameter of passageways 28 and 30, the diameter of the mandrels 62 and 66 may be about 0.90 mm and the diameter of the overwraps 64 and/or 68 may be about 0.3 mm. However, other dimensions are within the scope of the disclosed embodiments.

Further, in some embodiments, the mandrels 62 and 66 are formed from a first molybdenum-rhenium alloy and the coils overwraps 64 and 68 are formed from a second molybdenum rhenium alloy, which may be same or different than the first molybdenum rhenium alloy of the mandrel. Accordingly, in some of these embodiments, the molybdenum-rhenium alloy includes about 35 weight percent to about 55 weight percent of rhenium. Further, in these embodiments, the overwraps 64 and 68 may be made of molybdenum, or a molybdenum alloy, or a second molybdenum-rhenium alloy, or tungsten, or combinations thereof. In some embodiments, the mandrel and the overwrap may be made of substantially similar molybdenum-rhenium alloys. As will be appreciated, the overwraps 64 and 68 facilitate distribution of stress experienced by the mandrels 62 and 66 at points where the seal glasses 58 and 60 are in contact with the electrode leads 54 and 56, thereby substantially reducing the likelihood of any cracks or structural defects in the mandrel caused by the stress. Further, the seal glasses 58 and 60 may have lengths 59 and 61, which may vary depending on the composition of the mandrel or coil overwrap. Further, as illustrated, the ends of the two electrode leads 54 and 56 disposed inside the interior chamber 32 are coupled to the electrode tips 70 and 72. As described above with reference to FIG. 1, the electrode tips 70 and 72 may further include overwraps 74 and 76, such as tungsten overwrap disposed around the electrode tips.

Figure 4:
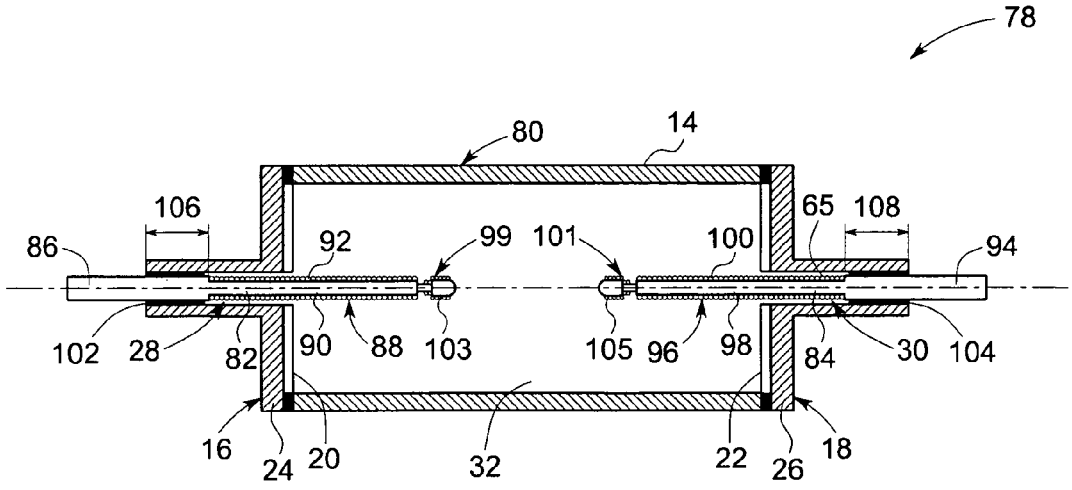

Referring to FIG. 4, a cross sectional view of an alternative embodiment of the lamp of FIG. 1 is shown and described below. As with embodiments of FIGS. 2 and 3, the presently contemplated embodiment includes a lamp 78 having an alternative lead system incorporated into an arc envelope assembly 80, which includes a ceramic arc envelope 14 and the end structures 16 and 18 coupled to the opposite ends 20 and 22 of the ceramic arc envelope 14. Further, the end structures 16 and 18 include flat structures 24 and 26 having openings extending into protruding passageways, such as hollow legs 28 and 30 communicative with an interior chamber 32. In the illustrated embodiments, the electrode leads 82 and 84 are disposed inside the hollow legs 28 and 30, and include two-component structures each having a shank coupled to a coil assembly. For example, in the illustrated embodiment, the electrode lead 82 includes a shank 86 coupled to a coil assembly 88, which coil assembly 88 includes a mandrel 90 having a coil overwrap 92 wrapped around the circumference and along the length of the mandrel 90. Similarly, the electrode lead 84 includes a shank 94 coupled to a coil assembly 96, which coil assembly 96 includes a mandrel 98 and a coil overwrap 100 wrapped around the circumference and along the length of the mandrel 98.

In certain embodiments, the shanks 86 and 94 and the coil assemblies 88 and 96 may include a molybdenum-rhenium alloy. In these embodiments, the molybdenum-rhenium alloy includes about 35 weight percent to about 55 weight percent of rhenium. In alternate embodiments, the coil overwraps 92 and 100 may be made of molybdenum, or a molybdenum alloy, or a second molybdenum-rhenium alloy, or tungsten, or combinations thereof.

Furthermore, the lamp 78 includes electrode tips 99 and 101 coupled to the electrode leads 82 and 84. In the illustrated embodiment, the electrode tips 99 and 101 may include overwraps, such as overwraps 103 and 105. As will be appreciated, these overwraps 103 and 105 sometimes act as heat sinks to absorb the heat from the electrode tip and dissipate the heat into the surroundings. In some embodiments, the electrode tips 99 and 101 and/or the overwraps 103 and 105 may include tungsten, or tungsten alloys, or rhenium, or rhenium alloys, or tantalum, or tantalum alloys, or combinations thereof.

Further, in the presently contemplated embodiment, the seal glasses 102 and 104 join the electrode leads 82 and 84 to the hollow legs 28 and 30. Although in the illustrated embodiment, the seal glasses 102 and 104 are located on the shanks 86 and 94, as will be appreciated, alternatively, the seal glasses 102 and 104 may be located on the coil assemblies 88 and 96. As will be appreciated, in embodiments where the seal glasses 102 and 104 are located on the coil assemblies 88 and 96, stress otherwise experienced by the mandrels 90 and 98 may be re-distributed due to the presence of coil overwrap on the mandrel, thereby substantially reducing the likelihood of any cracks or structural defects in the mandrel caused by the stress. Further, the seal glasses 102 and 104 may have lengths 106 and 108, which may vary depending on the composition of the mandrel, coil overwrap, or shank.

Figure 5:
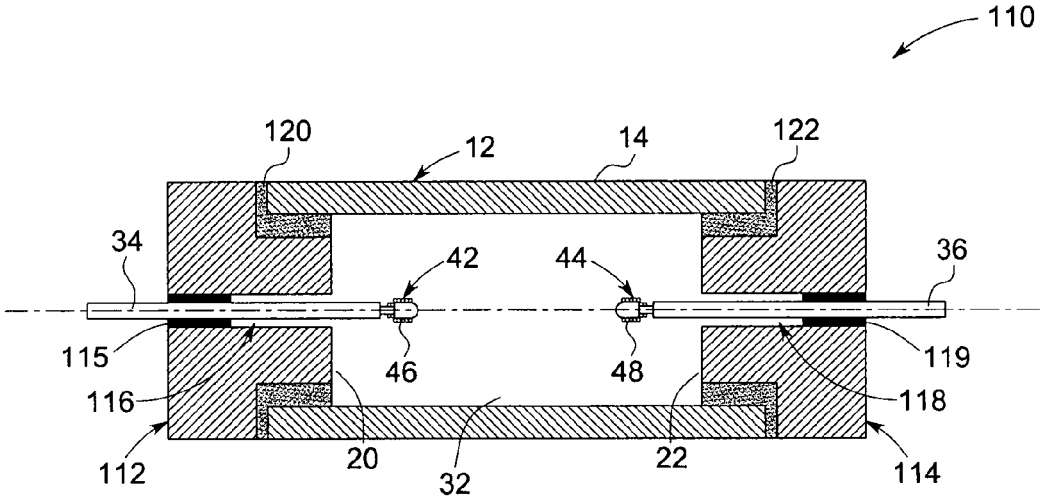
FIGS. 5 and 6 are cross-sectional views illustrating alternative end structures employed in the lamp in accordance with embodiments of the present technique.
Figure 6:
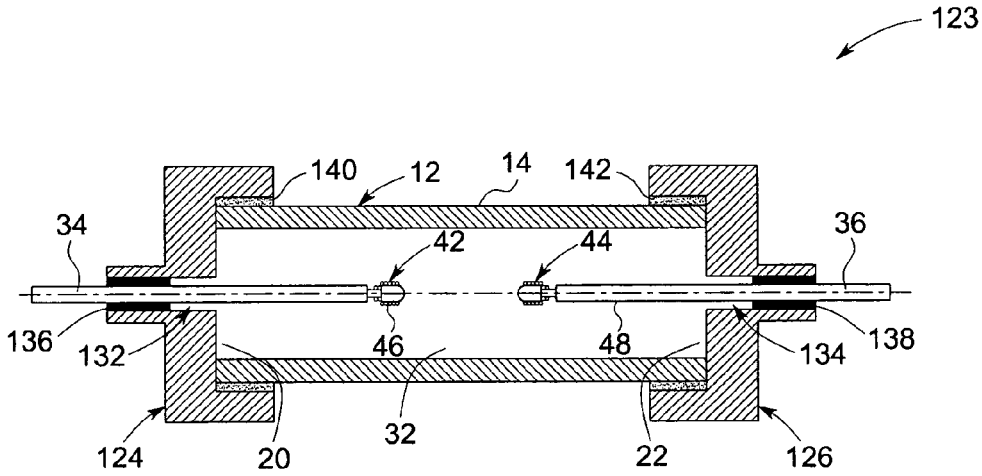

Further, FIGS. 5 and 6 illustrate alternative embodiments of the end structures 16 and 18 as illustrated in FIG. 1. In an alternative embodiment shown in FIG. 5, a cross-sectional view of the exemplary lamp 110 employing two plug-shaped end structures 112 and 114 is shown and described below. In the illustrated embodiment, the lamp 110 employs ceramic arc envelope 14, end structures 112 and 114 plugged into opposite ends 20 and 22 of the ceramic arc envelope 14. Further, in the illustrated embodiment, the plug shaped end structures 112 and 114 may include hollow legs or passageways 116 and 118, which house electrode leads such as electrode leads 34 and 36. In the illustrated embodiment, the electrode leads 34 and 36 are coupled to the passageways 116 and 118 by employing seal glasses 115 and 119. As illustrated, the end structures 112 and 114 are hermetically sealed to the ceramic arc envelope 14 by employing seal materials 120 and 122 that are disposed between the opposite ends 20 and 22 of the envelope 14 and the end structures 112 and 114. As illustrated, the seal interface of the seal materials 120 and 122 extends along the opposite ends 20 and 22 and into the interior surface of the arc envelope 14.

In another alternative embodiment illustrated in FIG. 6, a cross-sectional view of a lamp 123 having the ceramic arc envelope 14 is shown and described below. In the illustrated embodiment, the lamp 123 includes cap shaped end structures 124 and 126 coupled to the opposite ends 20 and 22 of the ceramic arc envelope 14. Further, the end structures 124 and 126 include hollow legs or passageways 132 and 134 protruding from the cap shaped end structures 126 and 128 and housing electrode leads such as electrode leads 34 and 36. Further, the electrode leads 34 and 36 are coupled to the passageways 132 and 134 by seal glasses 136 and 138. As illustrated, the end structures 124 and 126 are hermetically sealed to the ceramic arc envelope 14 by employing seal materials 140 and 142 that are disposed between the envelope 14 and the end structures 124 and 126. As illustrated, the seal interface of the seal materials 140 and 142 extends along the opposite ends 20 and 22 and into the interior surface of the arc envelope 14. As will be appreciated, in the embodiments illustrated in FIGS. 5 and 6, the electrode leads of FIGS. 1-4 may be fitted into the passageways 116 and 118 and/or passageways 132 and 134 in alternative embodiments of the present technique.

Figure 7:
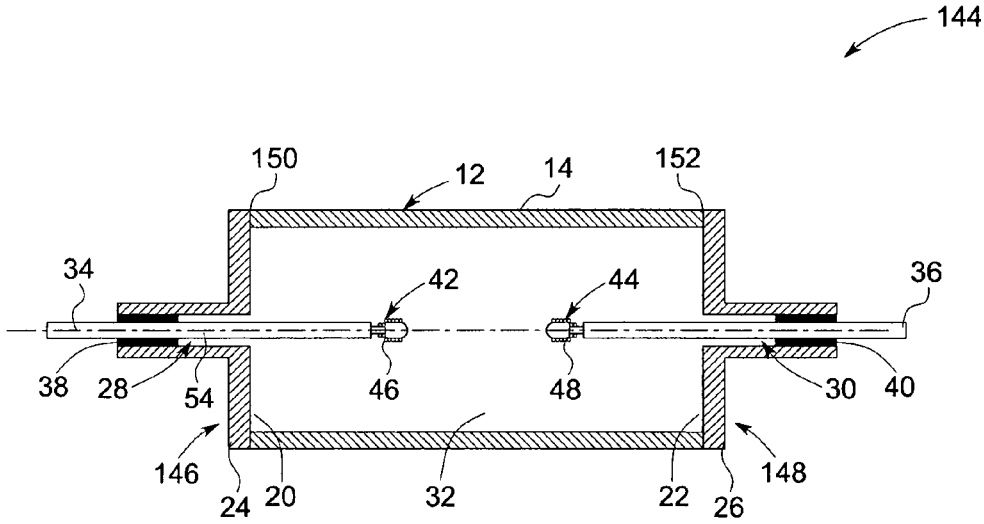
FIG. 7 is a cross-sectional view illustrating an alternative embodiment of the lamps of FIGS. 1-2 having end structures butt-sealed via diffusion bonding to the ceramic arc envelope.

In another alternate embodiment, FIG. 7 illustrates a cross-sectional view of a lamp 144 incorporating certain features of the lamp of FIGS. 1 and 2, and further including a unique seal between the components. In the illustrated embodiment, the lamp 144 includes a ceramic arc envelope 14 having opposite ends 20 and 22. As illustrated, the opposite ends 20 and 22 are butt-sealed without a seal material to the end structures 146 and 148 at joints 150 and 152. For example, the butt-sealed joints 150 and 152 may be achieved by diffusion bonding or co-sintering of the materials of the adjacent arc envelope 14 and end structures 146 and 148. Moreover, the butt-sealed joints 150 and 152 may be facilitated by applying localized heat (e.g., a laser beam) in the vicinity of the interface between these components.

Figure 8:
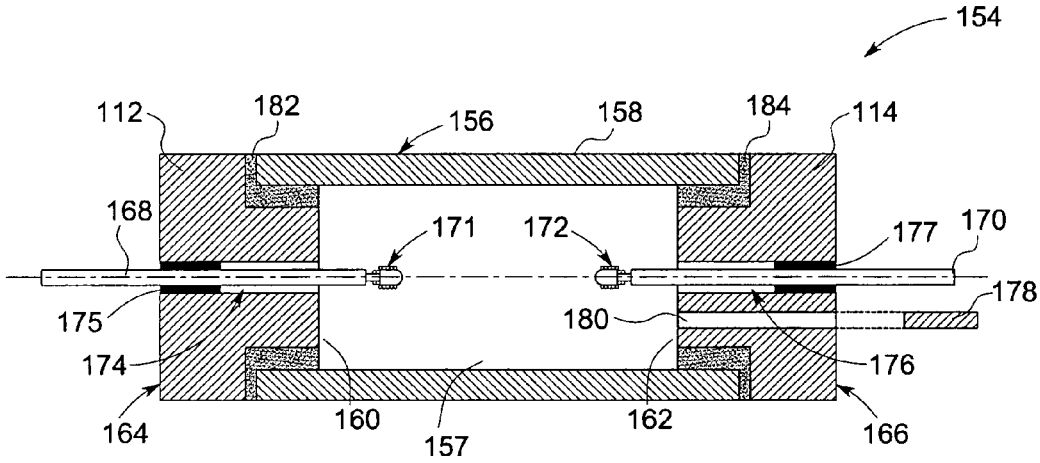
FIG. 8 is a cross-sectional view illustrating a lamp having an electrode lead shrunk-fit in each of the end structures in accordance with embodiments of the present technique.
Figure 9:
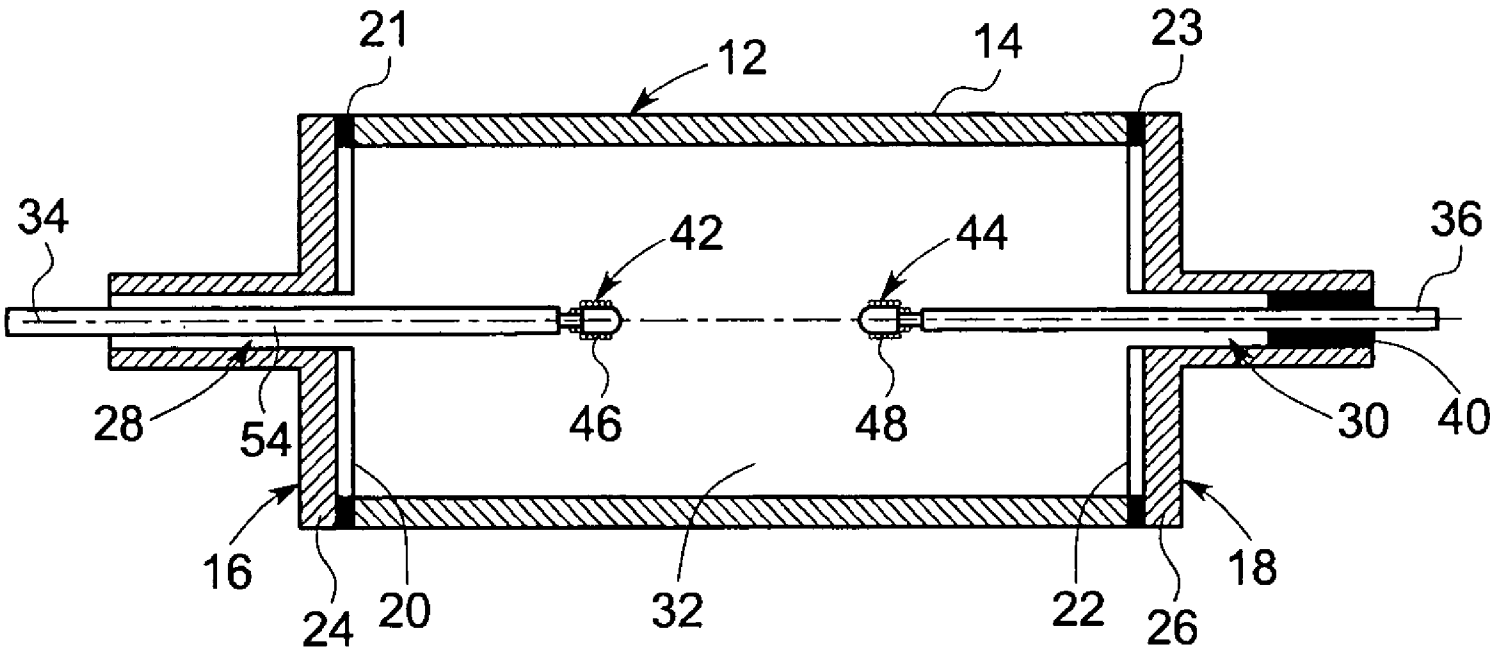
FIGS. 9-12 are cross-sectional views of the lamp illustrated in FIG. 2 further illustrating certain aspects of a method of dosing the lamp in accordance with embodiments of the present technique.

FIG. 8 is a cross-sectional view of an alternative embodiment of the lamp as illustrated in FIG. 1. In the illustrated embodiment, the lamp 154 includes an arc envelope assembly 156 having an envelope 158 with opposite ends 160 and 162. Further, the lamp 154 includes interior chamber 157 and end structures 164 and 166 plugged into opposite ends 160 and 162 of the ceramic arc envelope 156. The lamp 154 further includes electrode leads 168 and 170 coupled to each of the electrode tips 171 and 172. In some embodiments, the electrode leads 168 and 170 may be shrink-fitted into each of the end structures 164 and 166. For example, the electrode leads 168 and 170 may be shrink-fitted into the lead receptacles 174 and 176 by sinter bonding the electrode leads 168 and 170 into the end structures 164 and 166 at joints 175 and 177.

Further, the lamp 154 includes a plug member 178 exploded from a dosing passageway 180 in the end structure 166 in accordance with embodiments of the present technique. As will be appreciated, the lamp 154 is filled with a dosing material through the dosing passageway 180. As described above with reference to FIG. 1, in some embodiments, the dosing material includes rare gas and mercury. In other embodiments, the dosing material includes halide, such as bromide, or a rare earth metal halide. In some embodiments, the dosing material may be mercury-free. The dosing passageway 180 is subsequently sealed by the plug member 178. For example, the plug member 178 may be sealed by a seal material, diffusion bonding (e.g., using localized heating), or other suitable sealing techniques. In some embodiments, the plug member 178 includes a material, such as a cermet, having a coefficient of thermal expansion substantially similar or identical to that of the end structure 166.

As illustrated, the end structures 164 and 166 are hermetically sealed to the ceramic arc envelope 158 by seal materials 182 and 184. As mentioned above, the seal materials 182 and 184 used for the foregoing bonds have characteristics at least partially based on the type of materials used for the various lamp components, e.g., the arc envelope 158 and end structures 164 and 166. In an alternative embodiment, the end structures 164 and 166 may be butt-sealed to the ceramic arc envelope 158 with or without a seal material.

Although the illustrated embodiment of FIG. 8 employs the electrode leads similar to the ones illustrated in FIG. 2, as will be appreciated, the alternative embodiments of the electrode leads of FIG. 2 illustrated in FIGS. 3 and 4 may also be employed in the lamp 158. Similarly, depending on the application, in alternative embodiments, the end structures 164 and 166 may be similar to the end structures of FIGS. 5 and 6.

FIGS. 9-12 are cross-sectional side views of the arc envelope assembly 12 of FIG. 2 further illustrating a material dosing and sealing process in accordance with embodiments of the present technique. As will be appreciated, the illustrated process is also applicable to other forms of the arc envelope assembly, such as those assemblies illustrated in FIGS. 3-8. In the illustrated embodiment of FIG. 9, the arc envelope assembly 12 has two passageways 28 and 30, which house the electrode leads 34 and 36. These passageways 28 and 30, in the illustrated embodiment of FIG. 9, further act as dosing tubes. As illustrated, one of the two passageways 30 is sealed before the other passageway 28, such that the other passageway 28 can be used for injecting the dosing material into the arc envelope assembly 12. Once the passageway 30 is sealed, the arc envelope assembly 12 may be coupled to one or more processing systems to provide a desired dosing material into the arc envelope assembly 12.

Figure 10:
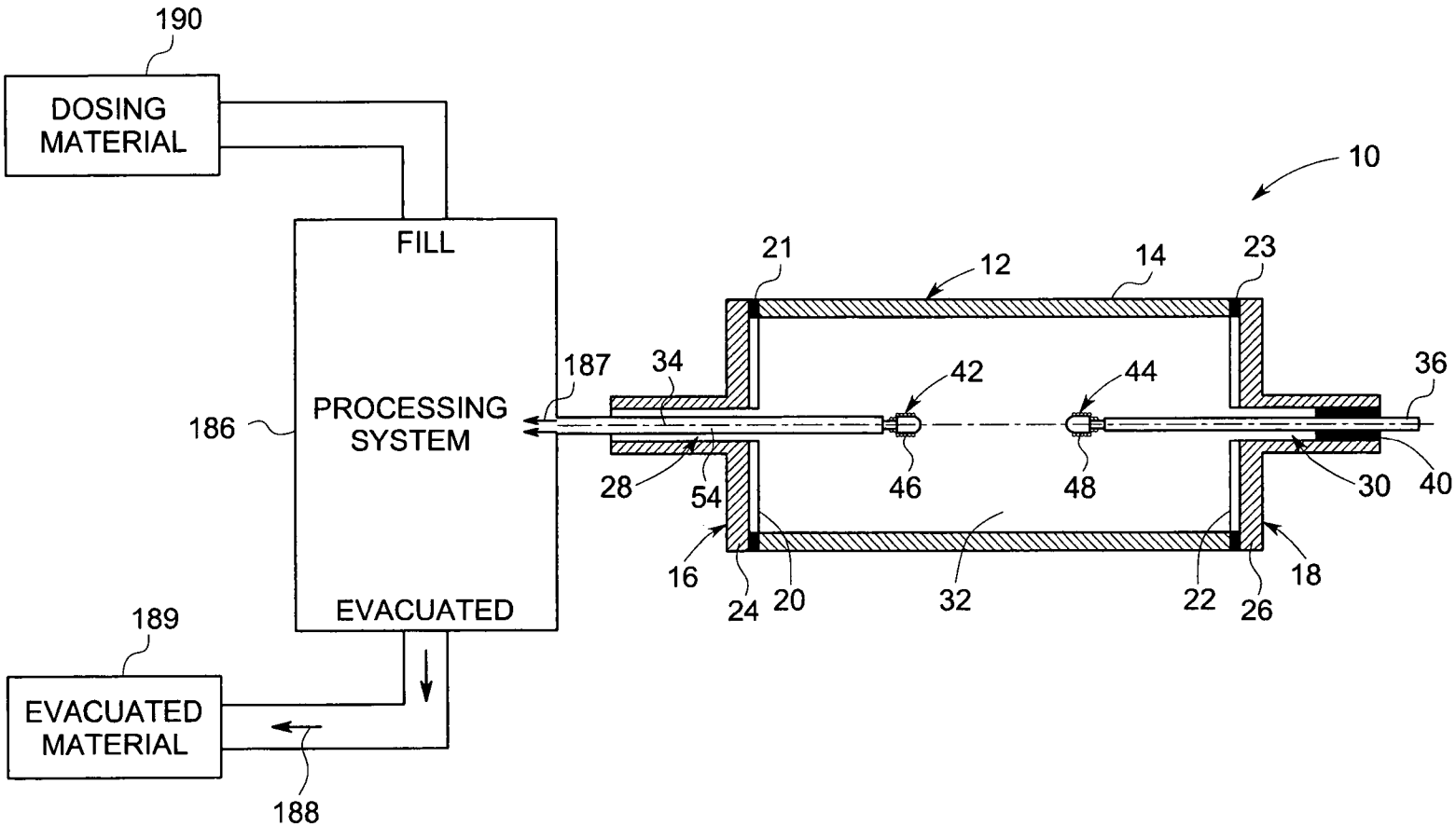
Figure 11:
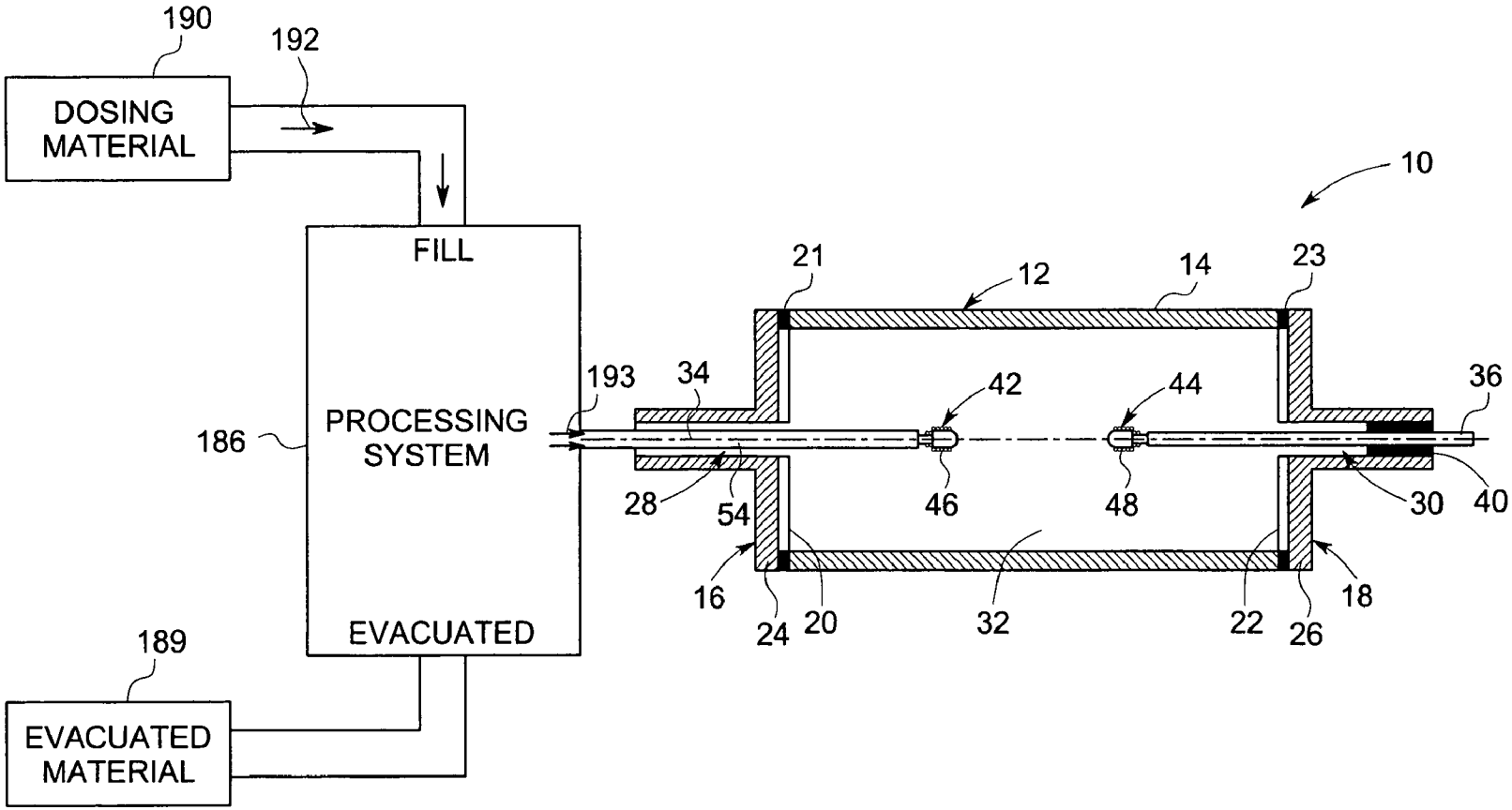

In the illustrated embodiment of FIG. 10, the processing system 186 operates to evacuate any substance 189 currently in the arc envelope 14, as indicated by arrows 187 and 188. For example, tubing can be connected between the processing system 186 and the dosing passageway 28. Once the arc envelope assembly 12 is evacuated as illustrated in FIG. 10, the processing system 186 proceeds to inject one or more dosing materials 190 into the arc envelope 14 as illustrated by arrows 192 and 193 shown in FIG. 11. For example, the dosing materials 190 may comprise a rare gas, mercury, a halide, and so forth.

Figure 12:
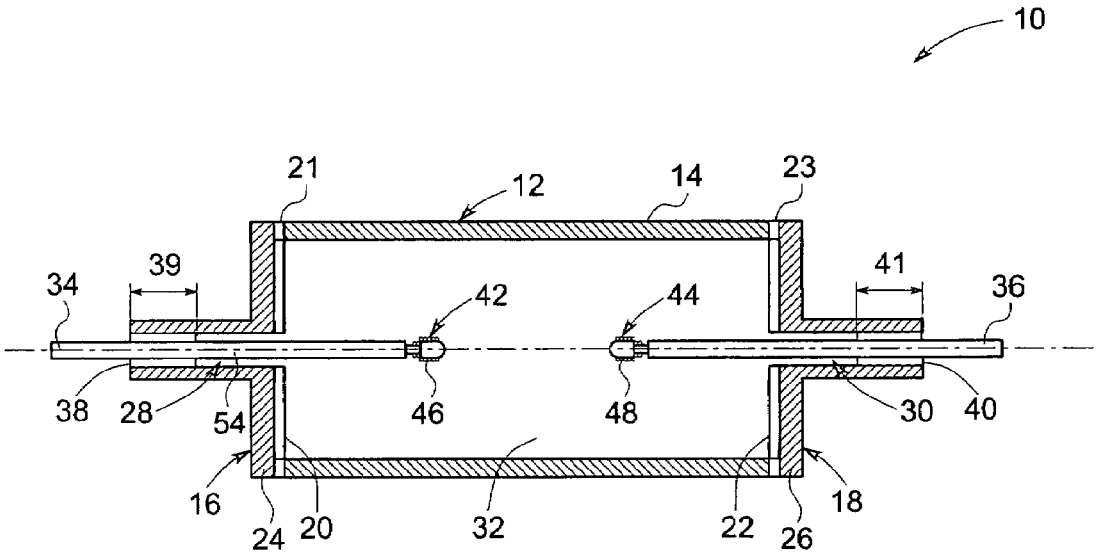

Furthermore, the dosing material 190 may be injected into the arc envelope 14 in the form of a gas, a liquid, or a solid, such as a dosing pill. After the desired dosing material 190 has been injected into the arc envelope 14, the present technique proceeds to close the passageway 28, as illustrated in FIG. 12. In addition, localized heat, such as a laser, may be applied to the hermetical seal 38 to improve the bond and closure of the passageway 28.

Figure 13:
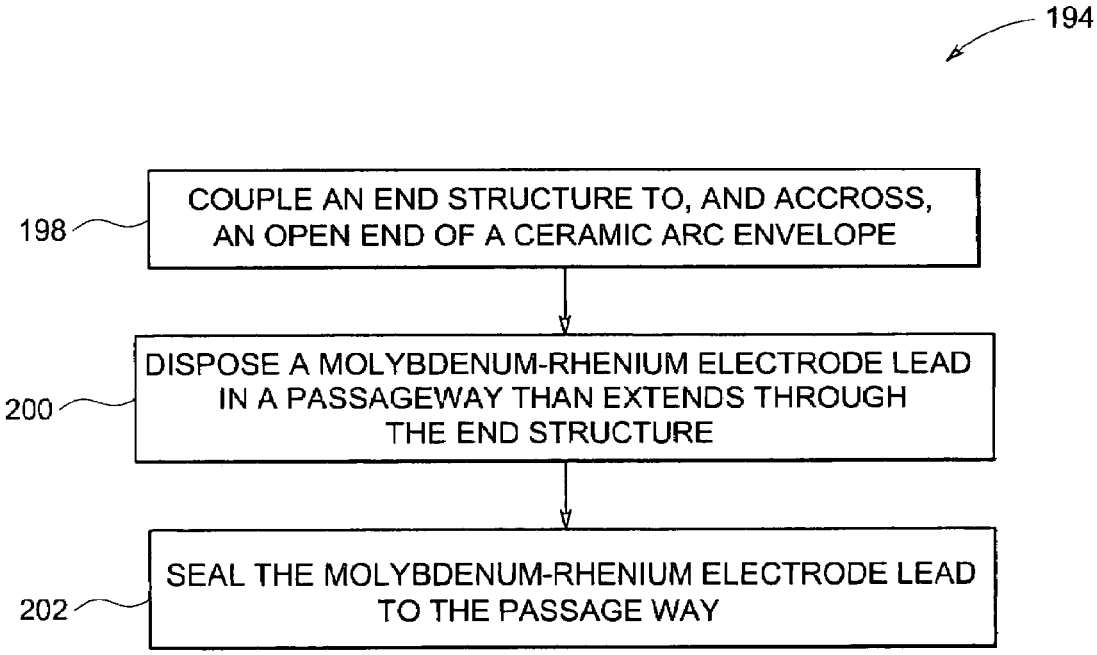
FIG. 13 is a flow chart illustrating an exemplary method of manufacturing a lamp in accordance with certain embodiments of the present technique.

Turning now to FIG. 13, this figure illustrates an exemplary process 194 for manufacturing the lamps and systems described above with reference to FIGS. 1-8. As illustrated, the process 194 begins by coupling the end structures to the ceramic arc envelope and extending across the ceramic arc envelope (block 198). At block 200, the coil assembly is disposed about a mandrel in a passageway that extends through the end structure, wherein the coil and the mandrel each comprise a molybdenum-rhenium alloy. Further, at block 202 the dosing passageway is sealed by employing seal materials as described above.

Figure 14:
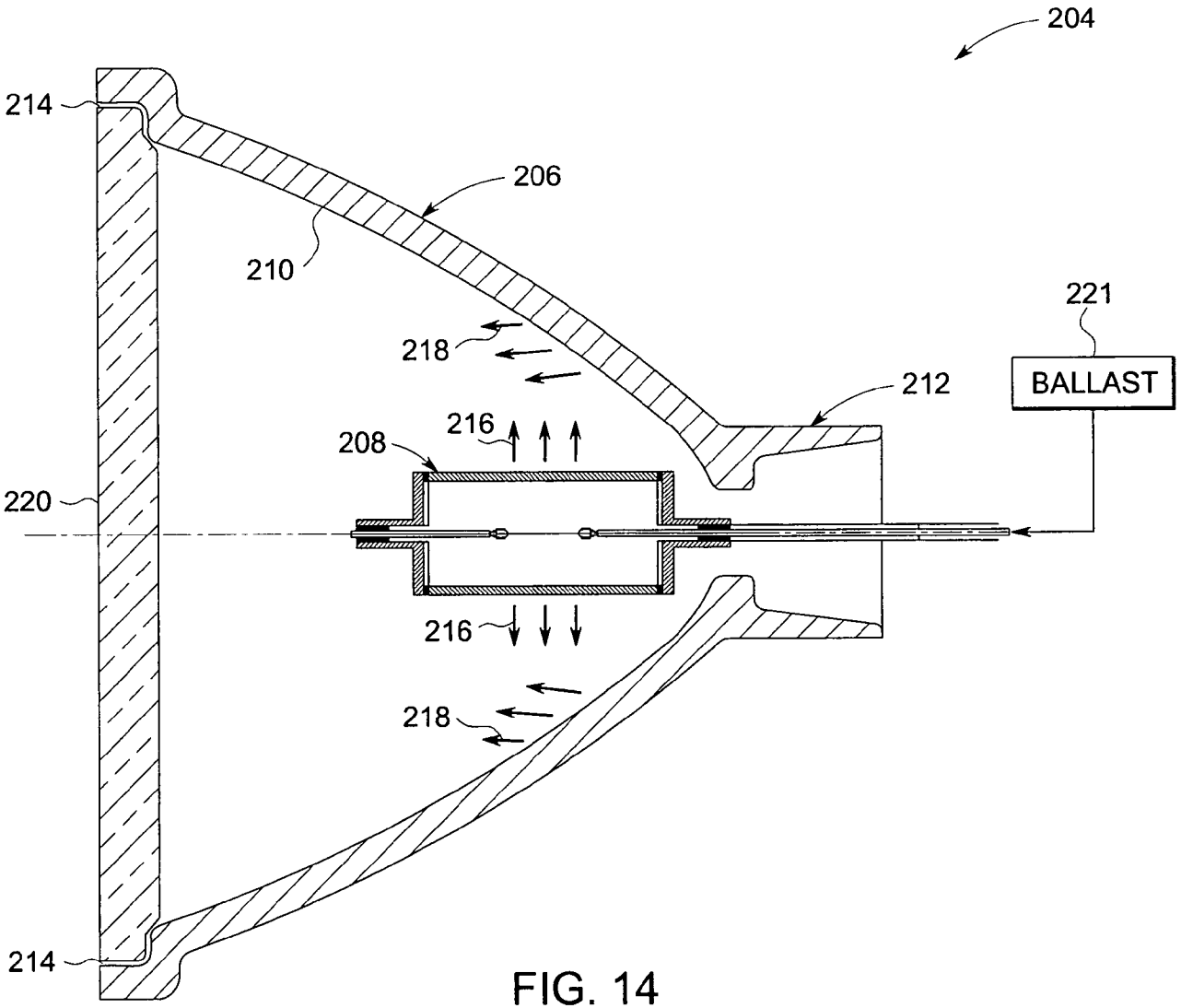
FIG. 14 is a cross sectional view of a reflective lamp assembly, such as an automotive head lamp, having a ceramic lamp disposed in a reflective outer shroud in accordance with certain embodiments of the present technique.
Figure 15:
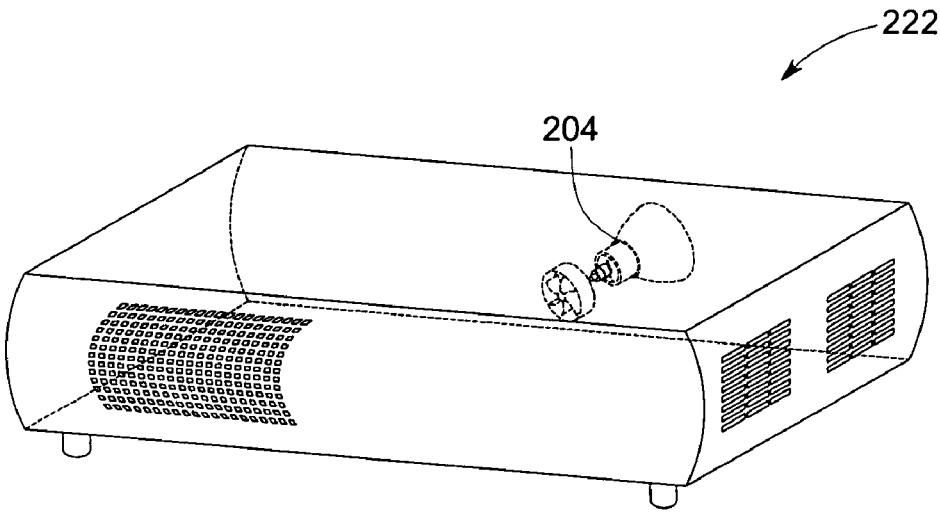
FIG. 15 is a perspective view of a video projection system having a ceramic lamp in accordance with certain embodiments of the present technique.
Figure 16:
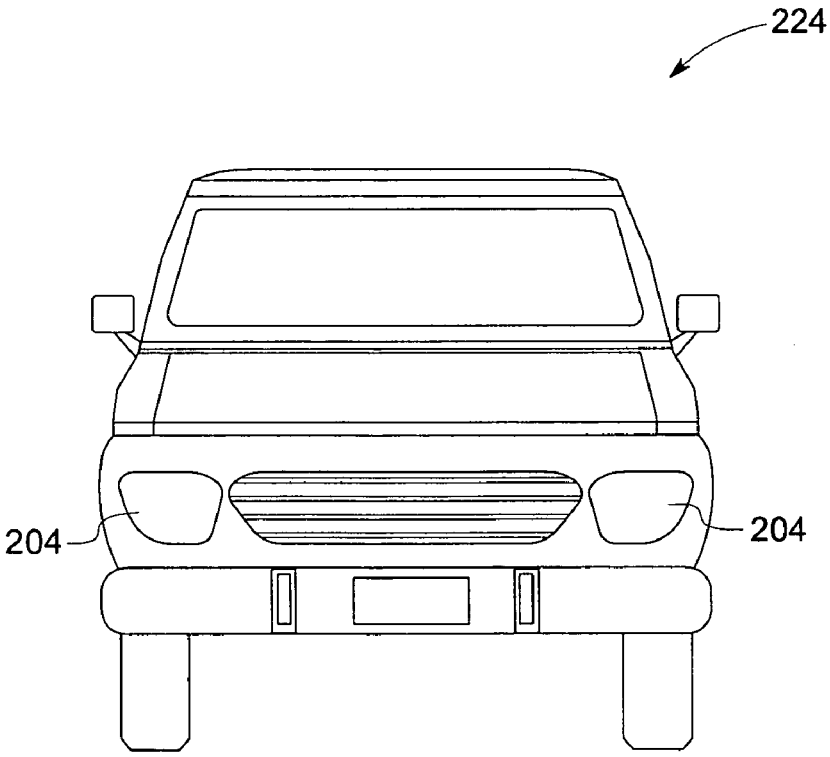
FIG. 16 is a perspective view of a vehicle, such as an automobile, having a ceramic lamp in accordance with certain embodiments of the present technique.

FIGS. 14-16 are exemplary systems employing the lamp of the present technique, e.g., the embodiments illustrated and described above with reference to FIGS. 1-8. In certain embodiments, the lamp of the present technique may be employed in a system which further includes a housing. In some embodiments, the housing includes a reflective outer shroud that at least partially surrounds the ceramic arc envelope. Further, the housing also includes a ballast 221 that is electrically coupled to the electrode lead. As will be appreciated, ballasts 221 are configured to apply starting voltage to the lamp and establish a current flow or an arc between the electrode tips. Once the lamp is operating, the ballast may also be used to regulate the current supply to the electrode lead. FIG. 14 illustrates an embodiment of a reflective lamp assembly 204 having an enclosure 206 housing an arc envelope assembly 208 in accordance with aspects of the present technique. As will be appreciated, in alternate embodiments, the arc assembly 208 may be replaced by any of the arc assemblies of FIGS. 1-8. Further, the enclosure 206 includes a curved reflective surface 210, a central rear passage or mounting neck 212, and a front light opening 214. As illustrated, the arc envelope assembly 208 is mounted in the mounting neck 212, such that the light rays 216 are directed outwardly from the assembly 208 toward the generally curved reflective surface 210. The curved surface 210 then redirects the light rays 216 forward toward the front light opening 214 as indicated by arrows 218. At the front light opening 214, the illustrated reflective lamp assembly 208 also includes a transparent or translucent cover 220, which may be a flat or lens-shaped structure to focus and direct the light from the arc envelope assembly 208. Moreover, the cover 220 may include coloring, such as red, blue, green, or a combination thereof.

In certain embodiments, the reflective lamp assembly 204 may be incorporated or adapted to a variety of applications, such as transportation systems, video systems, general purpose lighting applications (e.g., outdoor lighting systems), and so forth. For example, FIG. 15 illustrates an embodiment of a video projection system 222 comprising the reflective lamp assembly 204 illustrated in FIG. 14. By further example, FIG. 16 illustrates a vehicle 224, such as an automobile, having a pair of the reflective lamp assemblies 204 in accordance with certain embodiments of the present technique.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A lamp, comprising a ceramic arc envelope;

an end structure coupled to the ceramic arc envelope and extending across an opening in the ceramic arc envelope, wherein the end structure comprises a passageway communicative with an interior chamber of the ceramic arc envelope;

a molybdenum-rhenium electrode lead extending through and sealed with the passageway, wherein the molybdenum-rhenium electrode lead comprises a molybdenum-rhenium alloy; and an arc electrode tip coupled to the electrode lead inside the interior chamber.

2. The lamp of claim 1, wherein the molybdenum-rhenium alloy comprises about 35 weight percent to about 55 weight percent of rhenium.

3. The lamp of claim 1, wherein the molybdenum-rhenium alloy has a coefficient of thermal expansion in a range from about $5.5\times10^{-6}$/K to about $7\times10^{-6}$/K.

4. The lamp of claim 1, wherein the electrode lead has a ductility in a range from about 0.1 percent to about 3.0 percent.

5. The lamp of claim 1, wherein the electrode lead comprises:

a mandrel comprising a first molybdenum-rhenium alloy; and a coil wrapped around the circumference and extending along the length of the mandrel wherein the coil comprises molybdenum, or a molybdenum alloy, or a second molybdenum-rhenium alloy, or tungsten, or combinations thereof.

6. The lamp of claim 5, wherein the first and second molybdenum-rhenium alloys each comprise about 35 weight percent to about 55 weight percent of rhenium.

7. The lamp of claim 5, wherein the first and second molybdenum-rhenium alloys each have a coefficient of thermal expansion in a range from about $5.5\times10^{-6}$/K to about $7\times10^{-6}$/K.

8. The lamp of claim 1, wherein the molybdenum-rhenium electrode lead comprises:

a shank comprising a third molybdenum-rhenium alloy;

a coil assembly coupled to the shank, wherein the coil assembly comprises:

a mandrel comprising a fourth molybdenum-rhenium alloy; and a coil wrapped around the circumference and along the length of the mandrel, wherein the coil comprises a fifth molybdenum-rhenium alloy.

9. The lamp of claim 8, wherein the third, fourth and fifth molybdenum-rhenium alloys each comprise about 35 weight percent to about 55 weight percent of rhenium.

10. The lamp of claim 1, further comprising an overwrap disposed on the arc electrode tip, wherein the overwrap comprises tungsten, or a tungsten alloy, or rhenium, or a rhenium alloy, or tantalum, or a tantalum alloy, or combinations thereof.

11. The lamp of claim 1, comprising a dosing material disposed within the interior chamber, wherein the dosing material comprises a halide, or a metal halide, or both.

12. The lamp of claim 11, wherein the dosing material is mercury-free.

13. The lamp of claim 1, comprising a corrosive dosing material disposed within the interior chamber, wherein the molybdenum-rhenium alloy is resistant to the corrosive dosing material.

14. The lamp of claim 1, comprising a hollow member extending outwardly from the end structure and communicative with the passageway, wherein the electrode lead extends at least partially through the hollow member.

15. The lamp of claim 14, wherein the hollow member and the electrode lead are hermetically sealed to one another.

16. The lamp of claim 14, wherein the hollow member and the end structure comprise a ceramic material.

17. The lamp of claim 14, wherein the end structure comprises a ceramic material and the hollow member comprises a sixth molybdenum-rhenium alloy.

18. A system, comprising:

a lighting device, comprising:

a ceramic arc envelope having an interior;

a dosing material disposed within the ceramic arc envelope, wherein the dosing material comprises a corrosive material;

an end structure coupled to the ceramic arc envelope and extending across an open end of the ceramic arc envelope, wherein the end structure comprises a hollow leg communicative with the interior;

an electrode lead extending at least partially through and sealed with the hollow leg, wherein the electrode lead comprises a molybdenum-rhenium alloy;

an arc electrode tip coupled to the electrode lead;

a housing, comprising:

a reflective outer shroud at least partially surrounding the ceramic arc envelope; and a ballast electrically coupled to the electrode lead.

19. The system of claim 18, wherein the electrode lead comprises:

a mandrel comprising a first molybdenum-rhenium alloy; and a coil wrapped around the circumference and along the length of the mandrel, wherein the coil comprises molybdenum, or a molybdenum alloy, or a second molybdenum-rhenium alloy, or tungsten, or combinations thereof.

20. The system of claim 18, comprising a vehicle having the lighting device.

21. The system of claim 18, comprising a video projector having the lighting device.

22. The lamp of claim 1, wherein the molybdenum-rhenium alloy has About 40 weight percent to about 48 weight percent of rhenium.

23. The system of claim 18, wherein the molybdenum-rhenium alloy has about 40 weight percent to about 48 weight percent of rhenium.

24. A lamp, comprising:

a ceramic arc envelope;

an end structure coupled to the ceramic arc envelope and extending across an opening in the ceramic arc envelope, wherein the end structure comprises a passageway communicative with an interior chamber of the ceramic arc envelope;

a molybdenum-rhenium electrode lead extending through and sealed with the passageway, wherein the molybdenum-rhenium electrode lead comprises a molybdenum-rhenium alloy; and an arc electrode tip coupled to the electrode lead inside the interior chamber;

wherein, the molybdenum-rhenium alloy comprises about 35 weight percent to about 55 weight percent of rhenium;

wherein, the molybdenum-rhenium alloy has a coefficient of thermal expansion in a range from about $5.5\times10^{-6}$/K to about $7\times10^{-6}$/K; and wherein, the electrode lead has a ductility in a range from about 0.1 percent to about 3.0 percent.

* * * * *